United States Patent [19]

Schroeder et al.

[11] 4,345,409

[45] Aug. 24, 1982

[54] BRACE MEMBER AND WALL STRUCTURE

[75] Inventors: Donald E. Schroeder; Thomas Temperly, both of Milwaukee, Wis.

[73] Assignee: Inryco, Inc., Chicago, Ill.

[21] Appl. No.: 92,084

[22] Filed: Nov. 7, 1979

Related U.S. Application Data

[63] Continuation of Ser. No. 955,102, Oct. 26, 1978, abandoned.

[51] Int. Cl.[3] ..... E04C 3/12; E04C 3/18

[52] U.S. Cl. ..... 52/693; 52/696

[58] Field of Search ..... 52/368, 769, 471, 690–695, 52/729, 657, 22, 762, 696

[56] References Cited

U.S. PATENT DOCUMENTS

| | | | |
|---|---|---|---|
| 491,417 | 2/1893 | Fincher | 52/471 |
| 1,150,133 | 8/1915 | Lester | 52/22 |
| 1,726,500 | 8/1929 | Norris | 52/762 |
| 1,996,046 | 3/1935 | Green | 52/669 |
| 2,457,147 | 12/1948 | Hall | 52/577 |
| 2,578,465 | 12/1951 | Davis | 52/364 |
| 2,670,061 | 2/1954 | McMahon | 52/377 |
| 3,335,993 | 8/1967 | Tuttle | 52/693 |
| 3,407,547 | 10/1968 | Doke | 52/729 |
| 3,875,719 | 4/1975 | Menge | 52/669 |

FOREIGN PATENT DOCUMENTS

| | | | |
|---|---|---|---|
| 1077230 | 5/1980 | Canada | 52/693 |

*Primary Examiner*—John E. Murtagh

*Attorney, Agent, or Firm*—Merriam, Marshall & Bicknell

[57] ABSTRACT

An improved stud wall structure comprising a folded T-shaped windstrip brace member installed in a saw kerf extending diagonally across the structure for substantially eliminate racking. The T-shaped brace member has a double layer top member portion and a pair of spaced apart flanges extending substantially perpendicularly from said top member portion. The flanges are unconnected at their respective outwardly extending edges, and fasteners such as nails driven through the brace member wedge the unconnected flanges against the sides of the saw kerf to hold the brace member in place on the structure.

4 Claims, 6 Drawing Figures

FIG. 5
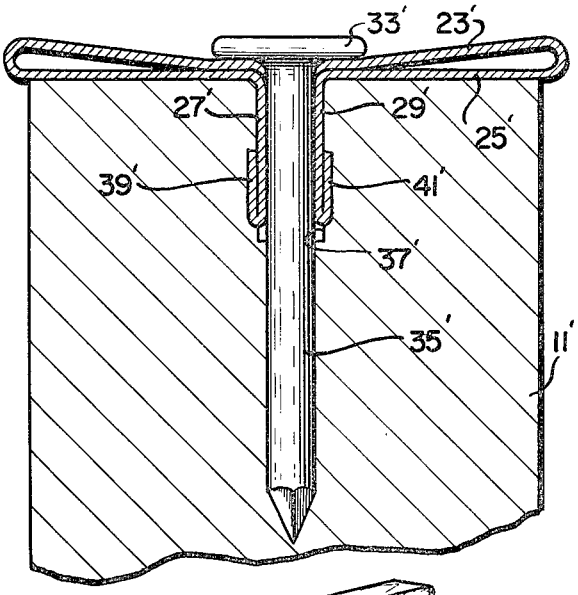
FIG. 4
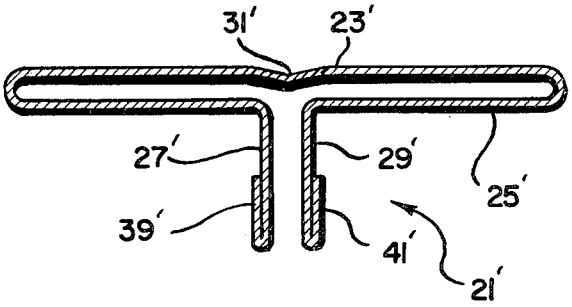
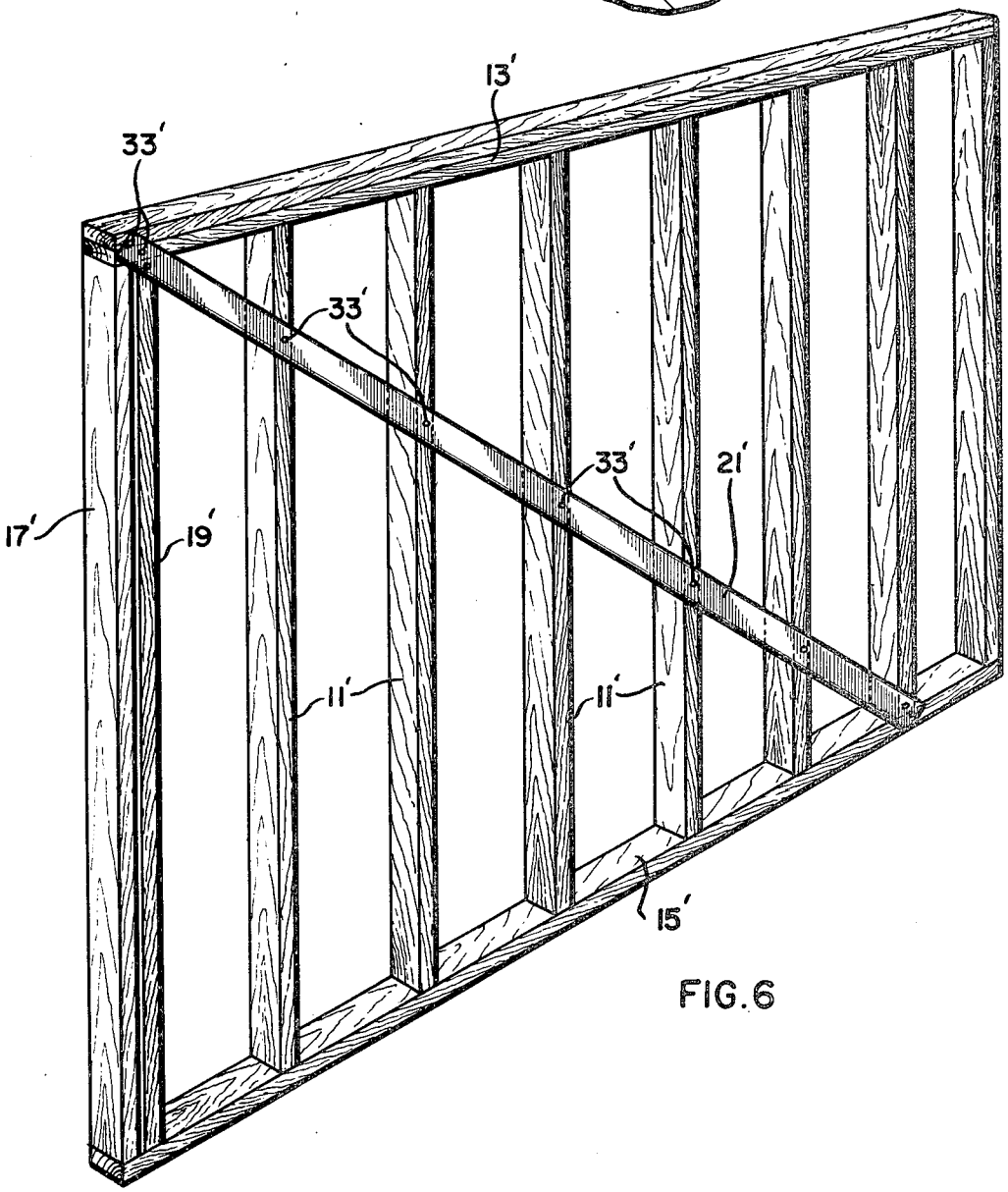
FIG. 6

BRACE MEMBER AND WALL STRUCTURE

This is a continuation, of application Ser. No. 955,102, filed Oct. 26, 1978 now abandoned.

BACKGROUND OF THE INVENTION

The present invention relates generally to construction materials and techniques and more particularly to windstrip bracing for frame structures such as stud walls and the like.

In the construction of buildings and other structures, exterior and interior walls are commonly provided by first erecting a wall frame structure comprising top and bottom plates between which are fastened spaced, upright nominal size two inch by four inch wooden studs and by then attaching the exterior or interior wall covering, such as dry wall or siding, to the studs. One problem associated with such construction is "racking", the term used to describe the lateral movement or the shifting of the top or bottom plate with respect to the other plate. Racking may occur in wooden structures due to wind or seismic load forces on the wall causing the top plate, for example, to shift laterally with respect to the bottom plate such that the studs correspondly shift and the wall frame loses its desired squaredoff, rectangular configuration.

It has therefore become common practice to nail, or otherwise fasten, a nominal size 1 inch by 4 inch wooden brace to the studding such that the brace extends downwardly from the top plate in a diagonal direction across several of the adjacent studs to the bottom plate of the wall frame structure. This added bracing substantially eliminates racking, but the addition of the brace poses another problem. The exterior siding or the dry wall, as the case may be, cannot then be nailed to the studs without notching portions of the studding and fitting the brace into the cut away portions. This, of course, adds greatly to the time required to erect the stud wall and contributes to a substantial rise in the cost of construction. Accordingly, it is desirable to provide a brace which, when installed, is substantially flat with respect to the surface of the stud wall, but which is also strong enough to prevent racking.

One such brace is described in U.S. Pat. No. 4,016,698, issued to D. Rogers wherein the wooden brace is replaced by a flat metal strap having a plurality of of preformed holes through which nails can be driven to attach the strap to the stud wall at various points on the diagonal.

A similar brace is described in U.S. Pat. No. 3,591,997, issued to J. Tennison, Jr., et al. As described therein, the edge flanges of a sheet metal channel member are accommodated in a pair of spaced, generally parallel saw kerfs extending diagonally across the stud wall from the top plate to the bottom plate. The channel member has multiple openings arranged in a pattern which insures that several of such openings are in alignment with each portion of the frame that the brace crosses thereby permitting the use of multiple fasteners to connect the brace to each stud as well as to the upper and lower plates of the frame.

Still another brace, or metal support strip, is disclosed in U.S. Pat. No. 3,875,719, issued to D. Menge wherein the brace comprises a generally T-shaped metal strip having a generally U-shaped portion forming the base leg of the T. When installed, the U-shaped portion is positioned in a saw kerf extending transversely across studs, trusses, joists, or the like. The strip is fastened, and the U-shaped portion is spread outwardly, by driving a nail downwardly inside the U-shaped portion through the bottom of the strip and into the structural element. Although some positive holding action for securing the brace in the transverse channel is provided by the expansion of the bottom of the U-shaped portion where the nail expands the metal outward into the wood, any positive holding action obtained thereby is believed to be minimal because the sides of the base leg at the bottom end of the U-shaped portion are joined by the U-shaped portion and thus expansion of the base leg near the bottom of the U-shaped portion is thought to be minimal. Indeed, it is believed that the lateral forces applied by the nail to the top of the U-shaped portion where it meets the top edge of the transverse channel may induce the nail or other fastener to pull from the wood with the result that the brace may become loose in the channel and weaken the structure.

SUMMARY OF THE INVENTION

Accordingly, it is an object of the present invention to provide a windstrip brace for wooden structures or frames, such as wall studding and the like, which provides a positive holding or gripping action to secure the brace to the wall studding and substantially eliminates any tendency of the brace to pull out. At the same time, it is an object of the invention to provide a stronger brace which is better able to withstand load forces applied to the brace and which thereby prevents racking.

In accordance with the principles of the present invention, there is provided, in a structure having a pair of parallel frame members and a plurality of parallel, spaced-apart support members extending between the frame members, the improvement comprising a brace member formed from a strip of sheet metal which has been folded to have a generally T-shaped cross section comprising a double layered top portion wherein portions of the strip adjacent the edges of the strip are folded away from the bottom layer of the top member portion to extend substantially perpendicularly from the top member portion and provide a pair of spaced apart flanges which are unconnected at their respective outwardly extending edges. When secured to a stud wall or the like, the flanges are received in a transverse channel in each of a plurality of adjacent ones of the support and frame members and are fastened such as by nailing to the structure. In particular, the fastening means which may, for example, be a nail is driven through the top layer of the top member portion such that the shank extends between the brace flanges to engage the structural member at the bottom of the channel. The brace member is sized such that when the nail is driven through the brace the brace flanges are pushed outwardly to wedge against the walls of the channel and secure the brace member to the structural member.

An optional inwardly directed channel or rib aligned with the brace flanges may be provided along the length of the top layer of the top brace member portion. The channel provides a guide for positioning the nails or other fastening members with respect to the brace member during installation.

In an alternative embodiment, the outwardly extending ends of the brace flanges are folded back on themselves along a portion of their lengths. Thus, when the nail is driven between the brace flanges, the upward edges of the folded flange will bite into the wood and further secure the brace in position.

Accordingly, the improvement of the present invention comprises a reinforced, double layered brace member in a frame structure which it is more resistent to racking resulting from load forces applied to the structures and which provides means for a more positive holding action to secure the brace member in the channels in the structural members.

BRIEF DESCRIPTION OF THE DRAWINGS

The features of this invention which are believed to be novel are set forth with particularity in the appended claims. The invention together with its further objects and the advantages thereof, may be best understood, however, by reference to the following description taken in conjunction with the accompanying drawings, in which like reference numerals identify like elements in the several figures and in which:

FIG. 4 is a cross-sectional view of an alternative embodiment of the brace member;

FIG. 5 is a cross-sectional view showing the brace member shown in FIG. 4 installed and in place in the channel through one of the structure members; and FIG. 6 is a perspective view showing the brace member of FIG. 4 installed and in place on the structure and further showing a specific arrangement or pattern of nailing the brace member to the structure.

DETAILED DESCRIPTION

Figure 1:
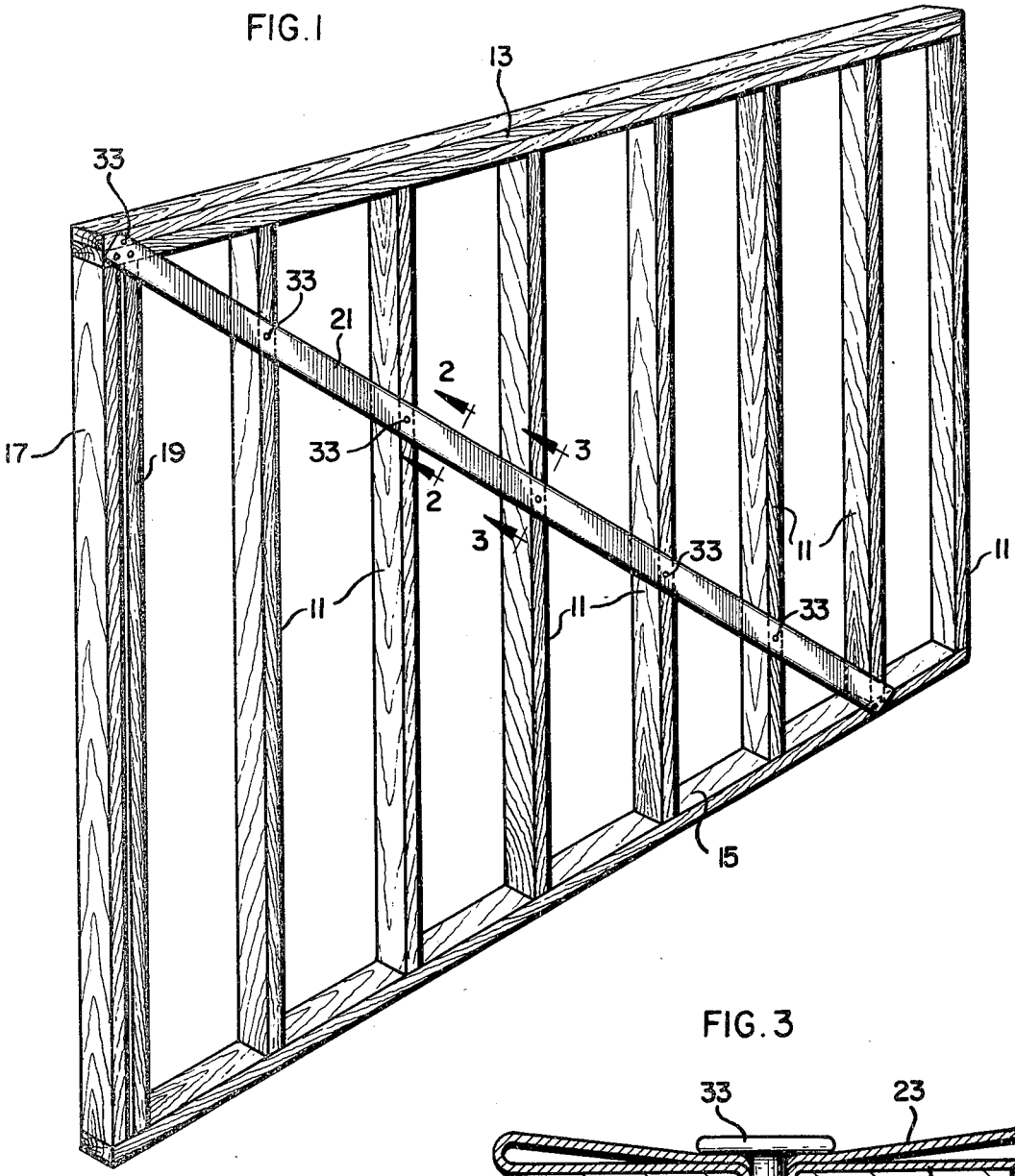
FIG. 1 is a perspective view illustrating the windstrip brace member installed and in place on a frame structure comprising a stud wall and illustrating a specific arrangement or pattern of nailing the brace member to the structure.

With reference now to FIG. 1, a wall structure such as the one shown there generally comprises a plurality of parallel, upright studs 11 extending between top and bottom plate members, 13 and 15, respectively. As heretofore mentioned, the structure is commonly constructed from nominal size two inch by four inch dimensioned, or two-by-four, lumber. The top plate member may comprise a pair of two-by-fours which are fastened together, such as by nailing, to provide added stability and load bearing capabilities. The top ends of the spaced-apart studs 11, in turn, are fastened, again by nailing, to the bottom side of the top plate member 13 while the bottom ends of the studs are similarly fastened to the single bottom plate member 15. Two studs, 17 and 19, are typically provided at the end of the structure to provide for facing attachment at the corner and to also strengthen and increase the rigidity of the wall structure.

In accordance with the present invention, a windstrip brace member 21 formed from galvanized steel or some other suitable material is installed to the wall structure to strengthen and lend rigidity to the wall structure and thereby substantially prevent the aforementioned problem of racking. As illustrated in FIG. 1, the brace member 21 is preferrably fastened at one end to the wall structure at or near the juncture of the double end studs, 17 and 19, and the top plate member 13. From that point, the brace member 21 extends downwardly in a diagonal direction, typically 45° to 60° to the bottom plate 15, the brace member being fastened to the studs 11 and the bottom plate 15.

Figure 2:
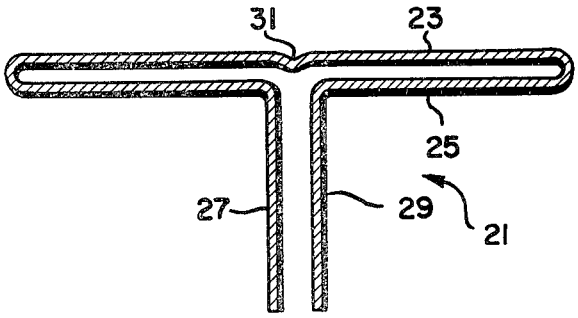
FIG. 2 is a cross-sectional view of the brace member taken along lines 2—2 in FIG. 1.

The brace member 21 is formed from a flat elongated strip of thin sheet metal by folding the metal to the configuration shown in cross-section in FIG. 2. There, it can be seen that the brace member 21, which has a generally T-shaped cross section, is folded from the metal strip to have a doubled layer top member portion comprising a top layer 23 and a bottom layer 25 underlying the top layer. As shown in FIG. 2, the folded junctures between the top and bottom layers, 23 and 25, are at the edges of the brace member. The edges of the bottom layer 25 of the top portion of the brace member are folded away from said top portion to extend substantially perpendicularly with respect to the top portion and provide a pair of spaced apart flanges, 27 and 29, which are unconnected at their respective outwardly extending edges. Hence, the T-shaped cross-section results. Typically, the width of the T-shaped brace member 21 across its top portion is in the order of one and 13/16 inches while the spaced apart flanges 27 and 29 extend outwardly for about three-quarters of an inch. The spacing between the spaced apart flanges 27 and 29 is in the order of one eighth inch.

An optional inwardly directed channel 31, or rib, in the top layer 23 is shown in FIG. 2. The channel 31, which is about 1/32 of an inch deep, extends the length of the brace member 21 and is located immediately above the space between the flanges 27 and 29 to provide a guide for positioning nails or other fastening means on the brace member during nailing or fastening, as the case may be.

To install the windstrip brace member 21 on the wall structure, a diagonal line may be drawn across the individual studs and plate members of the structure along the line on which the brace member is to be installed. This may be done, for example, by placing the brace member 21 on the wall structure with one edge coinciding with the desired installation line and then running a marker or pencil along the edge of the member to mark the installation line. Using a circular power saw, a single kerf, about three-quarters of an inch deep, is then cut in the studs and plate members of the structure along the installation line. The kerf provides a plurality of diagonally aligned transverse channels across the members of the wall structure which receive the flanges 27 and 29 of the brace member. After the brace member 21 is located in the saw kerf, it is fastened to the structure such as by nailing.

Figure 3:
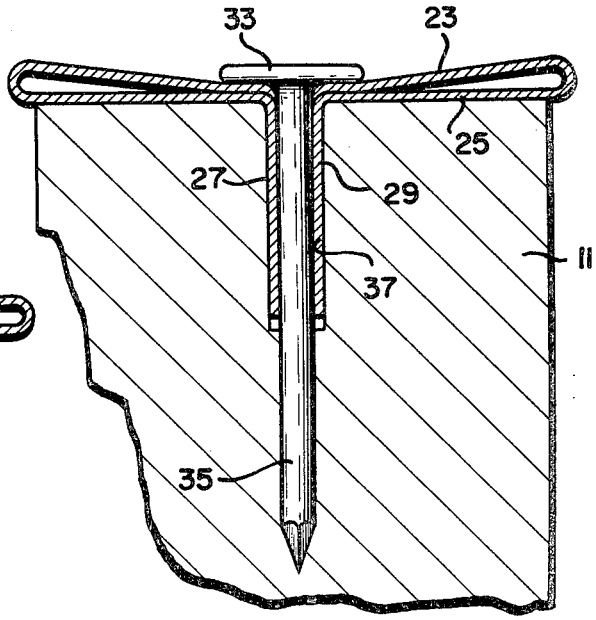
FIG. 3 is a cross-sectional view taken along lines 3—3 in FIG. 1 and showing the action of the fastening device on the brace member to secure the brace member to the structure.

Nails 33 are initially positioned along the channel 31 in the brace member and then driven through the brace member 21 into the studs 11 and the plate members 13 and 15 to secure the brace member to the structure as illustrated in FIG. 3. The shank 35 of the nail passes between the flanges 27 and 29 and is embedded in the wood beneath the saw kerf 37. A 12-Penny nail has been found to be the optimum size of nail to use with a brace member having the dimensions previously suggested, and as a result, the nail shank 35 forces the flanges 27 and 29 outwardly to wedge against the sides of the saw kerf 37 and thereby secure the brace member in position. Because the top portion of the brace member is double-layered, the brace member has greater strength than braces heretofore suggested and thus imparts greater rigidity and strength to the wall structure. An optimum nailing pattern to be used in nailing the brace member to the wall structure is also shown in FIG. 1.

An alternative embodiment of the brace member 21 is shown in FIG. 4 where it can be seen that the bottom ends of the flanges 27' and 29' are folded back to overlie a portion of the corresponding flanges. And accordingly, as shown in FIG. 5, when the shank 35' of the nail 33' wedges the flanges 27' and 29' against the sides of the saw kerf 37', the folded portions 39' and 41' of the flanges are embedded in the wood to further resist removal of the brace member 21' from the wall structure. To optimize the holding power of the flanges 27' and 29', if the dimensions of the brace member 21' in FIG. 4 are identical to the brace member 21 shown in FIG. 2, the bottom one-quarter inch of the ends of the flanges 27' and 29' are folded back, and the overall dimensions of the flanges 27' and 29' may be reduced to one-half inch. The depth of the saw kerf 37', when the brace member 21' shown in FIG. 4 is utilized, may also be about one-half inch. A second optimum nailing pattern for fastening the brace member to the wall structure is shown in FIG. 6.

An optional inwardly directed channel 31', or rib is provided in the top layer 23', as shown in FIG. 4. The channel 31' may extend for the length of the brace member 21' and is located immediately above the space between the flanges 27' and 29' to provide a guide for positioning nails or other fastening means on the brace member during nailing or fastening, as the case may be.

An optional inwardly directed channel 31', or rib is provided in the top layer 23', as shown in FIG. 4. The channel 31' may extend for the length of the brace member 21' and is located immediately above the space between the flanges 27' and 29' to provide a guide for positioning nails or other fastening means on the brace member during nailing or fastening, as the case may be.

Accordingly, the present invention discloses an improved wall structure utilizing a double layered brace member having increased strength to make the wall structure more rigid and prevent racking and exhibits better holding characteristics with respect to installation on the wall structure.

While particular embodiments of the present invention have been shown and described, it will be obvious to those skilled in the art that various changes and modifications may be made without departing from the invention in its broader aspects. Accordingly, the aim in the appended claims is to cover all such changes and modifications as may fall within the true spirit and scope of the invention.

What is claimed is:

1. In a structure having a pair of parallel frame members and a plurality of parallel, spaced-apart support members extending between said frame members, the improvement comprising:

a brace member comprising a strip of sheet metal formed to have a generally T-shaped cross section comprising a double layered top member portion having a top layer and a bottom layer, portions of said strip adjacent the edges of said strip extending away from the bottom layer of said top member portion in a substantially perpendicular direction with respect to said top member portion to provide a pair of spaced apart flanges, said flanges being unconnected at their respective outwardly extending edges;

a transverse channel in each of a selected plurality of adjacent ones of said support members and said frame members, said channels being aligned in the diagonal direction across said structure to receive said brace member and sized to receive said brace flanges; and means for fastening said brace member to said structure, said fastening means having a shank portion extending through said top brace member portion, said shank extending between said brace flanges to engage said support member at the bottom of said channel, said shank being sized to expand said brace flanges outwardly to wedge against the walls of said channels and secure said brace member to said structure members.

2. The improvement claimed in claim 1 wherein said brace member has a channel along the length of said top layer of said top member portion, said channel being aligned with and directed inwardly toward said brace flanges, said channel providing a guide for positioning said fastening means with respect to said brace member.

3. The improvement claimed in claim 1 wherein the outward ends of said brace flanges are folded back to overlie a portion of said flanges, said folded back ends being located between said flanges and said channel walls to lodge in said channel walls when said fastening means expands said brace flanges to engage said channel walls.

4. The improvement claimed in claim 1 wherein said brace member has a channel along the length of said top layer of said top member portion, said channel being aligned with and directed inwardly toward said brace flanges, said channel providing a guide for positioning said fastening means with respect to said brace member, and wherein the outward ends of said brace flanges are folded back to overlie a portion of said flanges, said folded back ends being located between said flanges and said channel walls to lodge in said channel walls when said fastening means expands said brace flanges to engage said channel walls.

* * * * *